US005113702A

United States Patent [19]

Capps

[11] Patent Number: 5,113,702

[45] Date of Patent: May 19, 1992

[54] BOAT AND DOCK GUARD

[76] Inventor: Lloyd O. Capps, Rte. 5, Box 338, Claremore, Okla. 74017

[21] Appl. No.: 515,851

[22] Filed: Apr. 30, 1990

[51] Int. Cl.[5] ..... B63B 59/02

[52] U.S. Cl. ..... 114/219; 114/230; 405/212

[58] Field of Search ..... 114/44, 45, 219, 220, 114/230; 405/1, 211, 212, 213, 216, 218

[56] References Cited

U.S. PATENT DOCUMENTS

| | | | |
|---|---|---|---|
| 2,754,792 | 7/1956 | Baird | 114/230 |
| 3,084,517 | 4/1963 | Bell | 405/213 |
| 3,151,595 | 10/1964 | Stainbrook | 114/230 |
| 3,177,839 | 4/1965 | Nolf | 114/230 |
| 3,336,896 | 8/1967 | Burnett | 114/230 |
| 4,679,517 | 7/1987 | Kramer | 114/45 |
| 4,920,907 | 5/1990 | Richter | 114/219 |

*Primary Examiner*—Sherman Basinger
*Assistant Examiner*—Stephen P. Avila
*Attorney, Agent, or Firm*—Head & Johnson

[57] ABSTRACT

A boat dock for use to store boat therein, the boat dock including a boat slip having an open entry, opposed sidewalls and a front, a dock guard secured to each dock sidewall at the entry and extending laterally from the sidewall to which it is attached and forwardly of the entry. A first intermediate guard affixed to one of the dock sidewalls and extending a short distance from the sidewall, a second intermediate guard affixed to the other sidewall opposite to the first intermediate guard, the second intermediate guard extending a short distance from the sidewall, the first intermediate guard being adjustable so that the spacing between the first and second intermediate guards is that which is slightly greater than the width of the boat to which the dock is adapted and a pair of padded stop members secured to the dock front and spaced apart and positioned to receive the forward position of the boat bow therebetween and a winch secured to the dock front between the pair of padded stop members, the winch having a retractable flexible member, the outer end of which is attached to the bow of the boat.

5 Claims, 4 Drawing Sheets

BOAT AND DOCK GUARD

SUMMARY OF THE INVENTION

In the United States and many foreign countries a large number of recreational boats are kept in boat stalls. The use of boat stalls is prevalent not only on fresh water lakes in the United States but in inlet and mooring areas along the sea coast. In the past boat docks have typically consisted of an open slip with parallel sidewalls and a front wall, the open end of the slip being opened so that the boat can be moved therein, and the end of the boat stall opposite the end entry is usually provided with a walkway which connects to walkways along both sidewalls. Such boat docks as commonly employed today offer little protection to boats, and for this reason many boat owners carry with them in their boats bumpers or fenders which hang out over the sides of the boat so as to protect the boat against the sidewalls and forward portion of the slip in which the boat is positioned.

Due to the lack of good facilities to receive and maintain a boat in a boat slip, boats are frequently damaged in the process of piloting a boat into a slip and, while in the slip, are damaged due to wave action.

The present disclosure is directed to a boat and dock guard, and more particularly, to a new system of arrangement of a boat and dock guard to substantially reduce the possibility of damage to a boat in the process of piloting the boat into and out of the boat dock slip, and, in addition, the invention provides means of securely maintaining a boat within a boat dock slip to prevent the possibility of damage to the boat due to wave action.

Accordingly, the disclosure herein is of an improved boat and dock guard for use to store a boat therein. The boat and dock guard includes a boat dock slip having an open entry, opposed sidewalls and a front. Usually a walkway is provided around both of the sidewalls and the front. The dock is typically floated on or supported above a body of water.

A dock guard is secured to each of the dock sidewalls at each side of the entry. Each of the dock guards extends laterally from the sidewall to which it is attached and forwardly of the entry. Each dock guard has a resilient surface thereon, and in the preferred arrangement includes an elongated vertical tubular elastomeric member received about an axle, the length of the tubular member being such as to extend well above the height of the gunwale of the boat to which the dock is adapted.

A first intermediate guard is affixed on one of the dock sidewalls and extends a short distance from the sidewall. The guard has a resilient surface thereon and, like the dock guards, is preferably in the form of a vertical axle member having a tubular elastomeric member thereon, the height of the first intermediate guard being such as to extend above the gunwale of the boat to which the dock is configured.

A second intermediate guard is affixed to the other of the dock sidewalls opposite to the first intermediate guard and is preferably like the first guard, that is, is preferably formed of a vertical axle member receiving a tubular elastomeric member.

The second intermediate guard is adjustable with respect to the distance by which it extends away from the second sidewall. By the adjustability of the spacing of the second intermediate guard with the second sidewall, the spacing between the first and second intermediate guards is adjusted to be that which is just slightly greater than the width of the boat to which the dock is dimensioned. In this way the short spacing between the first intermediate guard and first sidewall allows passenger to easily step from the boat onto the walkway adjacent the first sidewall while, at the same time, the spacing between the first and second intermediate guards assures that the boat, when in the slip, is snugly received and supported against damage due to wave action.

A pair of padded stop members is secured to the dock front. The stop members are spaced apart in a position to receive the forward portion of a boat bow therebetween. The padded stop members extend out away from the dock forward end and are dimensionally adjustable so as to conform to the shape of the boat bow.

A winch is secured to the front of the boat dock between the pair of padded stop members. The winch has a retrievable, flexible strap extending from it. The flexible strap has a hook on the outer end to attach to the bow of the boat, and the winch can be rotated to withdraw the flexible strap and pull the boat bow into firm and secure engagement with the pair of padded stop members.

The improved boat and dock guard thus described provides a slip for snugly and securely receiving a boat therein in a manner such that the possibility of damaging the boat as it is piloted into the slip is minimized, and, further, the possibility of damage to the boat while in the slip is also substantially reduced.

A better understanding of this disclosure will be had by reference to the following description and claims, taken in conjunction with the attached drawings.

DESCRIPTION OF THE DRAWINGS

FIG. 3 is taken along the line 3—3 of FIG. 1.

DESCRIPTION OF THE PREFERRED EMBODIMENT

Figure 1:
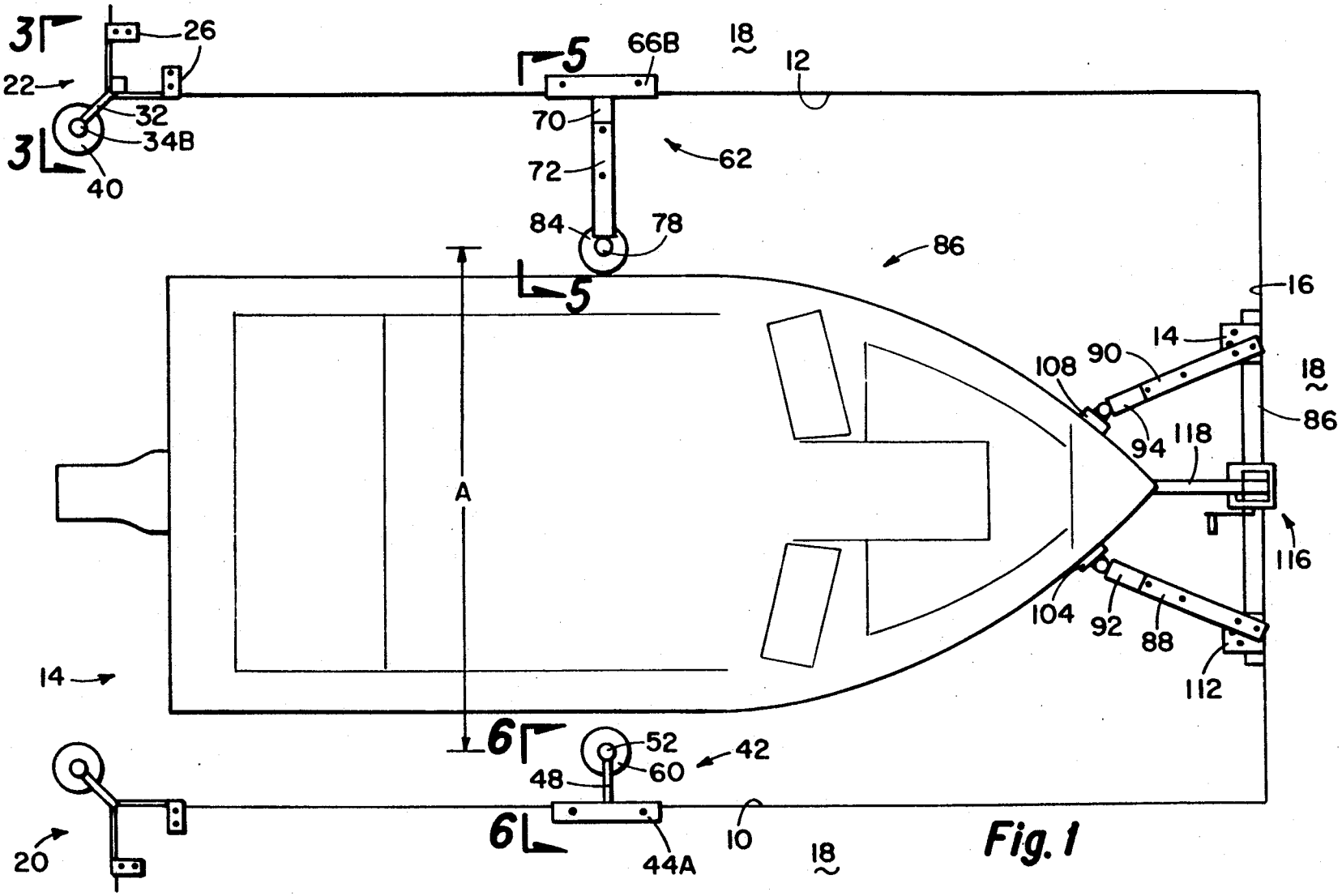
FIG. 1 is a plan view showing a boat dock in a slip therein and with the elements making up the improved boat and dock guards of this invention and showing a boat positioned within the boat dock.

Referring to the drawings and first to FIG. 1, an improved boat and dock guard having the improvements of this disclosure is illustrated. The boat and dock guard has a slip therein to receive a boat. The dock having a first sidewall 10, a second spaced apart and parallel sidewall 12, an open entry generally indicated by the numeral 14 and a dock front wall 16.

A walkway 18 typically extends along both the first and second sidewalls 10 and 12 and the front walls 16, the walkway therefore being U-shaped.

The boat dock described up to this point is typical of many boat docks as they exist today without facilities to guard and retain a boat within the dock, and for this reason many boat owners carry with them bumpers and/or fenders which can be hung out on the sides of the boat to protect the boat against damage. The improved dock of this disclosure alleviates the necessity for bumpers or fenders.

A first dock guard, generally indicated by the numeral 20, is secured to the first sidewall 10 at the slip entry 14. The dock guard 20 extends forwardly of the entry 14 and laterally of the sidewall 10. In like manner, a second dock guard 22 is affixed to the second sidewall 12 and extends outwardly from the sidewall and forwardly of the dock entry 14.

Figure 3:
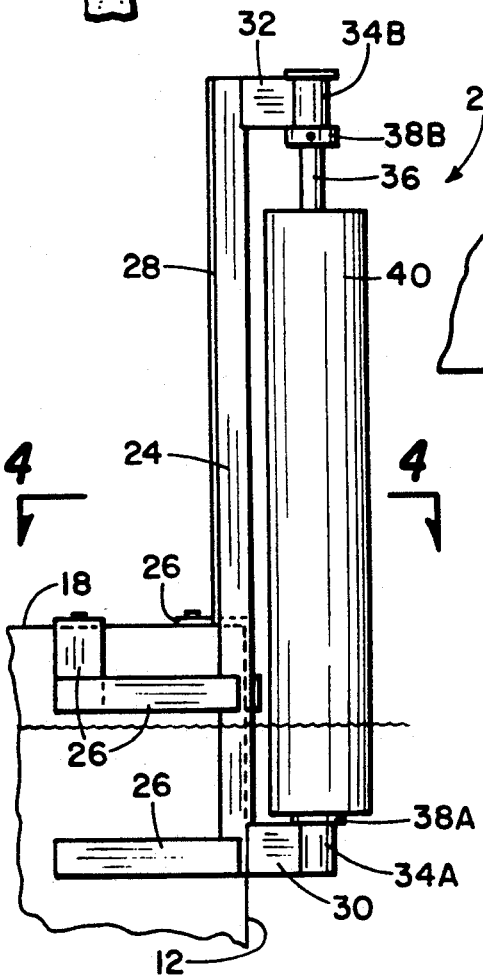
FIG. 3 is an elevational view of a dock guard which is secured to a dock sidewall at the entry of the slip, the dock guard extending laterally from the sidewall to which it is attached and forwardly of the entry.
Figure 4:
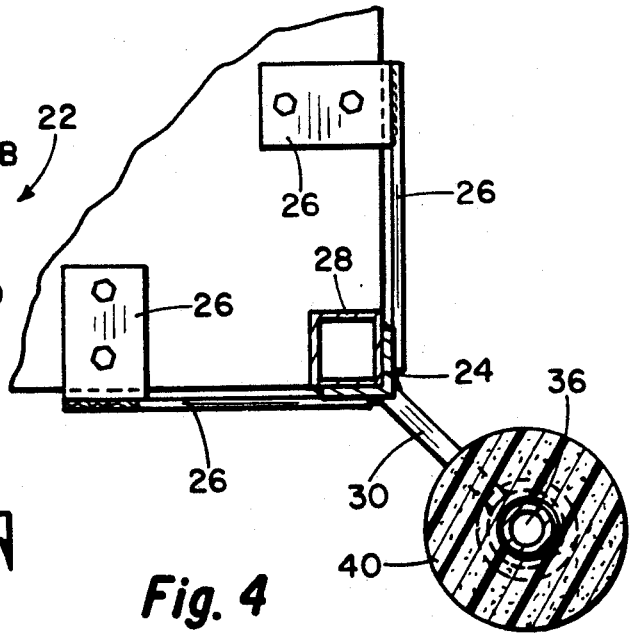
FIG. 4 is a fragmentary horizontal cross-sectional view, slightly enlarged, taken along the line of 4—4 of FIG. 3 showing more details of the dock guard.

The details of construction of the preferred embodiment of the dock guard 22 is illustrated in FIGS. 3 and 4. A vertical bracket 24, preferably in the form of a length of angle-iron, is affixed to second sidewall 12 at the dock forward end. Lateral brackets 26 are used to secure the vertical bracket 24 and hold it in firm upright position. In addition, a length of square tubing 28 may be welded to the vertical bracket 24 to reenforce the vertical bracket. The lateral bracket 26 may be arranged in a variety of ways to attach the second dock guard 22 position.

A lateral extending horizontal spacer member 30 extends from the lower end of vertical bracket 24, and, in like manner, a second horizontal spacer 32 extends from the upper end. Secured at the outer end of the spacer members 30 and 32 are short tubular members 34A and 34B which receive a vertical axle 36. Collars 38A and 38B received on axle 36 serve to retain it in position within tubular members 34A and 34B. The collar members 38A and 38B may include set screws to maintain axle 36 in position and to permit its removal.

Rotatably secured on axle 36 is a tubular elastomeric member 40, which is preferably at least 4 inches in diameter. The elastomeric member 40 provides a resilient element against the gunwales of a boat which may be engaged as the boat is being piloted into the boat slip.

Figure 6:
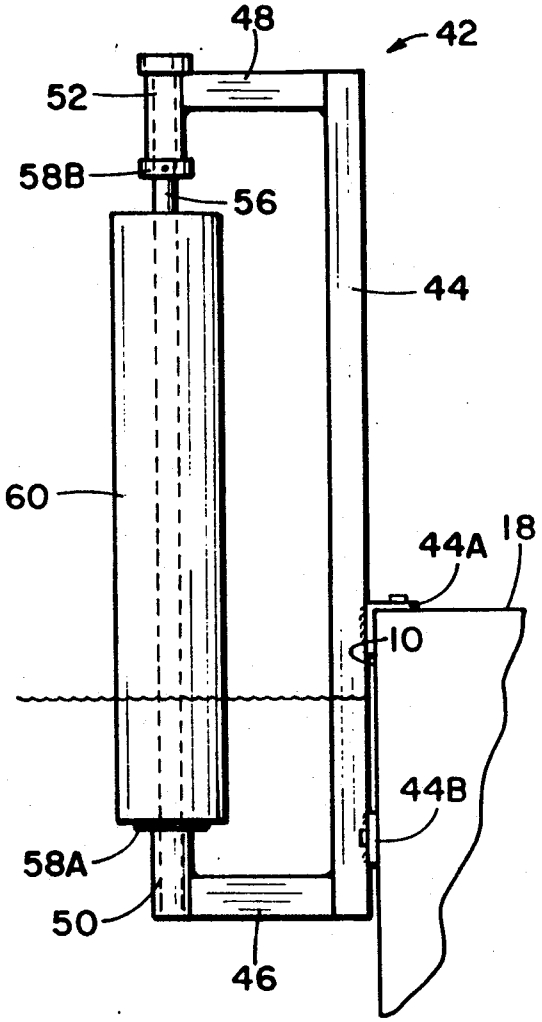
FIG. 6 is an elevational view taken along the line 6—6 of FIG. 1 showing the first intermediate guard as affixed to the first sidewall.

Affixed to the boat dock first sidewall 10 between the entry 14 and the front wall 16 is a first intermediate guard, generally indicated by the numeral 42. The details of guard 42 are shown best in FIG. 6. The first intermediate guard 42 is formed of a vertical bracket 44, which may be a length of angle-iron or square tubing or the like, the lower portion of bracket 44 being secured to the dock first sidewall 10 and walkway 18 bny means of attachment elements 44A and 44B, the exact configuration being selectable and the requirement being that they securely support the vertical bracket 44. At the bottom of bracket 44 and extending horizontally is a horizontal lower spacer 46, and, in like manner, a top horizontal spacer 48 is affixed to the upper end of the bracket 44. The outer end of spacer 46 receives a tubular element 50, and the outer end of the horizontal upper spacer receives tubular element 52. Received within the tubular elements 50 and 52 is an axle 56. Collars 58A and 58B received on the axle 56 are secured in position between the tubular elements 50 and 52.

Rotatably received on axle 56 is a tubular elastomeric member 60. A cross-sectional view of elastomeric member 60 of FIG. 6 would have the appearance of the elastomeric member 40 and axle 36, as shown in FIG. 4.

Figure 5:
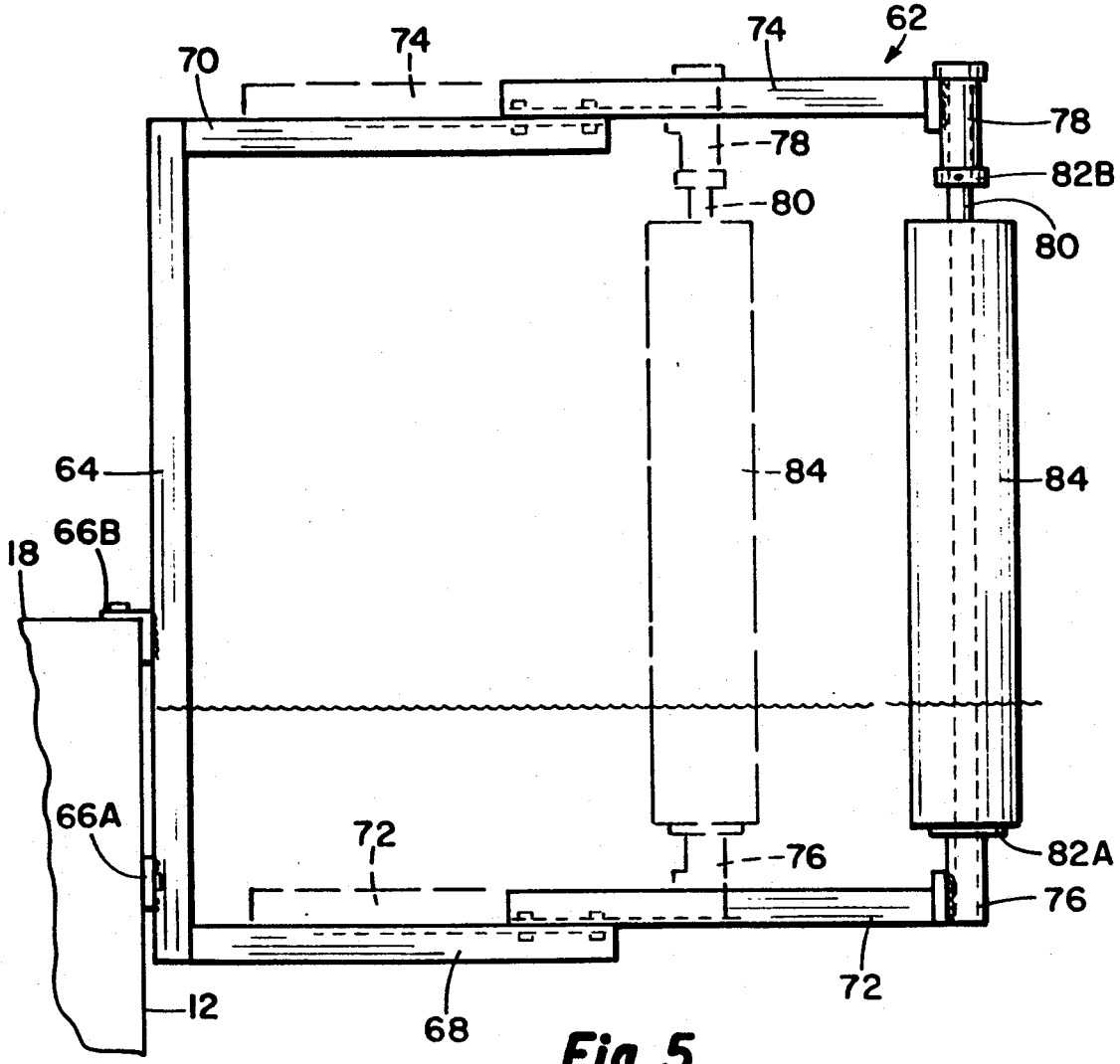
FIG. 5 is an elevational view taken along the line 5—5 of FIG. 1 showing the second intermediate guard and showing in phantom outline, how the second intermediate guard can be positioned so that the spacing of it from the second dock sidewall can be varied.

Referring again to FIG. 1, there is affixed to the dock sidewall 12, spaced opposite the first intermediate guard 42, a second intermediate guard, generally indicated by the numeral 62. The details of the second intermediate guard are shown best in FIG. 5. A vertical bracket 64 is secured to the dock second sidewall 12 and walkway 18 by means of attachment elements 66A and 66B, the exact configuration of which may vary.

Extending horizontally from the lower end of bracket 64 is a horizontal lower spacer 68, and extending from the upper end of bracket 64 is an upper horizontal spacer 70. The length of the horizontal upper and lower spacers 68 and 70 may vary considerably, but generally are longer than those corresponding elements found in the first intermediate guard 42.

Affixed to the lower horizontal spacer 68 is a spacer extender member 72, and, in like manner, affixed to the upper horizontal spacer 70 is an upper spacer extender 74. The relative position of the lower and upper horizontal spacers 72 and 74 can be adjusted by means of bolts with respect to spacers 68 and 70.

Affixed to the lower spacer extender 72 is a tubular element 76, and, in like manner, affixed to the outer end of upper spacer extender 74 is a tubular element 78.

Received within upper and lower tubular elements 76 and 78 is a vertical axle 80, which may be held in place by collars 82A and 82B. Received on axle 80 is an elastomeric tubular member 84.

Referring again to FIG. 1, it can be seen that the spacing "A" between the axle of the first intermediate guard 42 and the second intermediate guard 62 can be adjusted so as to be slightly greater than that of the width or beam of a boat, generally indicated by the numeral 86, positioned within the boat stall. It can be seen that instead of one affixed intermediate guard 42, two variable spacing intermediate guards 62 may be employed. However, the preferred arrangement is that the one guard 42 be fixed in spacing from the first dock sidewall 10 so that the boat is always held in position within the dock adjacent one of the walkways 18, that is, the walkway along first sidewall 10 so that passenger may safely and conveniently step from the boat onto walkway 18 adjacent the first sidewall 10.

Figure 2:
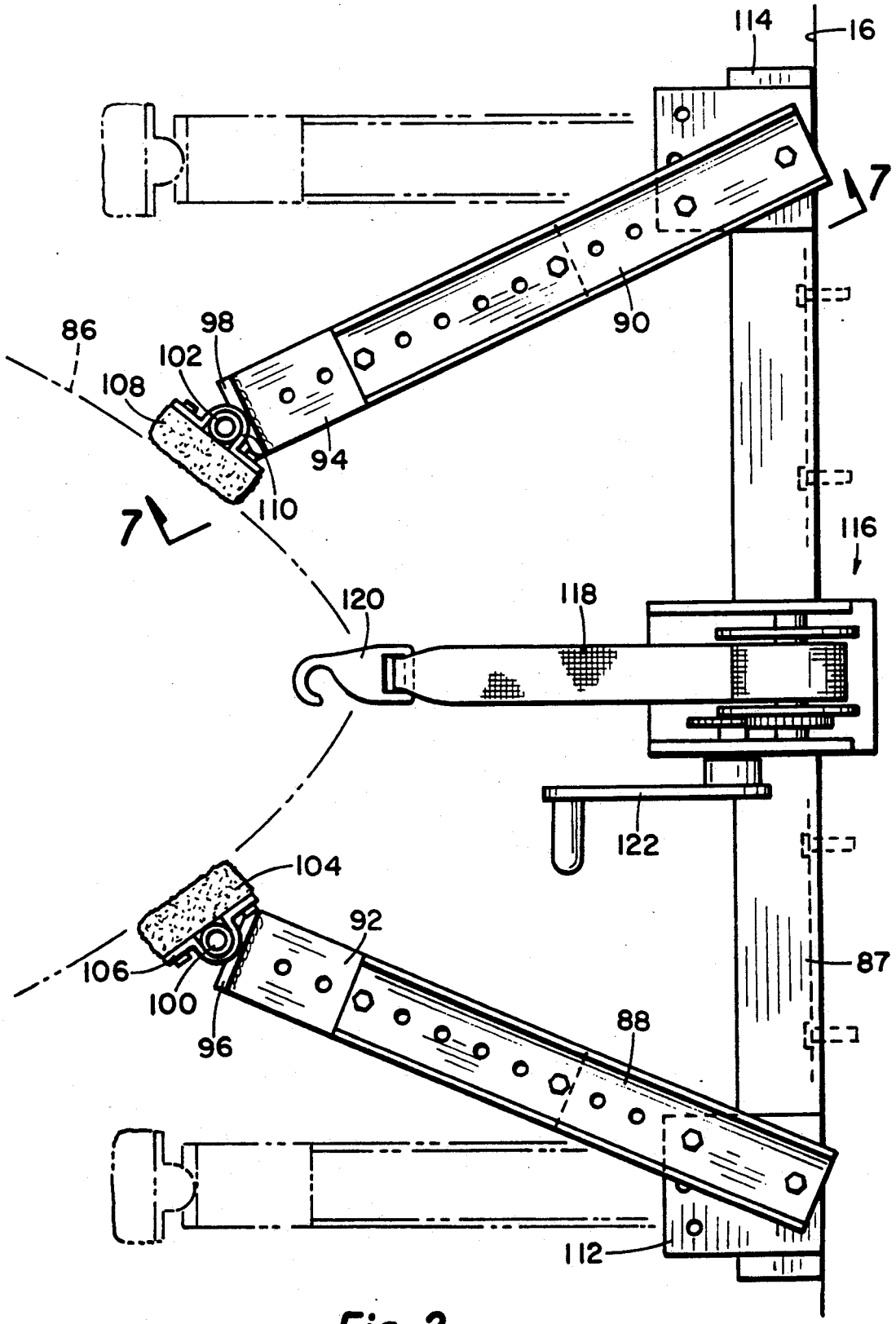
FIG. 2 is an enlarged partial plan view of the portion of the improved boat and dock guard which functions to provide padded stop members to secure a boat bow portion when the boat is within the dock slip.
Figure 7:
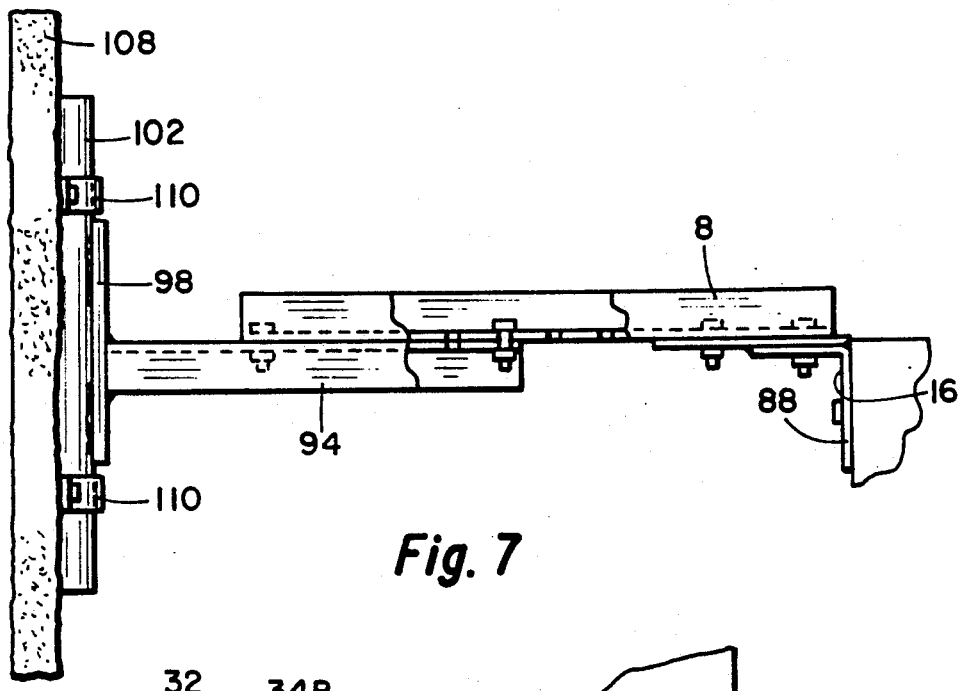
FIG. 7 is partial elevational view taken along the line 7—7 of FIG. 2 showing one of the padded stop members and arm supporting it, the stop member being configured to engage the bow end of a boat.

FIG. 2 is a plan view of the apparatus employed in the improved boat and dock guard of this disclosure for engaging and securing the bow portion of boat 86. A horizontal bracket 87 is secured along the dock front wall 16. Extending outwardly from bracket 87 adjacent one end thereof is a first horizontal arm 88 which, as illustrated, is in the form of a structural channel member. In like manner, a second horizontal arm 90 extends from the other end of bracket 87. Horizontal arm 88 has an extender portion 92, and second horizontal arm 90 has an extender portion 94. The extender portions shown are also formed of structural channels, the channels being inverted with respect to each other.

A vertical plate 96 is affixed to the outer end of arm extender 92, and, in like manner, a vertical plate 98 is to the outer end of arm extender 94. Attached to vertical plate 96 is a vertical tubular member 100, and attached to plate 98 is a vertical tubular member 102. A vertical elastomeric member 104 is held to the vertical tubular members 100 by means of U-shaped straps 106, which are frequently referred to as a pipe-strap. Elastomeric member 108 is held to the tubular member 102 by pipe-straps 110.

The horizontal arms 88 and 90 can be adjusted so that the outer ends are closer to or further away from each other by means of plates 112 and 114, which are affixed to the opposite ends of the horizontal bracket 86. The plates 112 and 114 have holes therein so that by selecting holes in alignment with mating holes within the brackets a bolt may be inserted between the bracket and the plates to angularly position the horizontal arms 88 and 90.

In addition, the angular position of the elastomeric members 104 and 108 can be adjusted by the provisions of the pipe-straps 106 and 110 so that the forward face of the elastometric members 104 and 108 conform to the shape of the boat bow portions which they engage. In this manner, the entire boat receiving portion can be accurately adjusted to snugly and securely receive the bow of the boat to which the dock is adjusted.

Positioned on the horizontal bracket 87 intermediate horizontal arms 88 and 90 is a winch, generally indicated by the numeral 116. The winch has a flexible belt 118 extending from it. The belt has a hook 120 at the outer end adaptable to hook into an eye bolt (not shown) typically formed at the bow of most recreational type boats. With hook 120 in the boat eye bolt, winch 116 may be actuated by manually rotating handle 122 to retract belt 118 and pull the boat in secure engagement with the elastomeric members 104 and 108.

A winch of the type indentified by the numeral 116 is a commonly used item in boat dock applications and typically includes a locking mechanism (not shown) so that when the belt 118 is tightened the winch is locked and will hold the belt into position until the lock is relieved.

In addition, a chain may be used to extend around the winch or any portion of the boat dock structure to lock the boat against thievery. The boat dock of this disclosure describes a unique and highly adaptable dock for mooring recreational-type boats in a manner so that the boat may be piloted into the dock slip with the minimal chance of damage to the boat and, when in the slip, is held in a secure position against wave action.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purpose of exemplification, but is to be limited only by the scope of the attached claim or claims, including the full range of equivalency to which each element thereof is entitled.

What is claimed is:

1. A boat dock for use to store a boat therein, the boat dock comprising:

a boat slip having an open entry, opposed sidewalls and a front, the entry being open to receive a boat therein between the opposed sidewalls, the dock being floated on or supported above a body of water;

a dock guard secured to and extending laterally from each said sidewall to which it is attached and forwardly of said entry, each dock guard having a vertical cylindrical member and a thick walled tube formed of elastomeric material received on said cylindrical member;

a first intermediate guard affixed on one of said dock sidewalls and extending a short distance from such sidewall, the first intermediate guard having a resilient surface thereon;

a second intermediate guard affixed on the other of said dock sidewalls opposite to said first intermediate guard, the second intermediate guard having a resilient surface thereon;

means to adjustably select the spacing between said second intermediate guard with respect to said sidewall to which it is affixed whereby spacing between the first and second intermediate guards can be adjusted to that which is slightly greater than the width of the boat which the dock is adapted to receive;

a pair of padded stop members secured to said dock front, the stop members being spaced apart and positioned to receive the forward portion of a boat bow therebetween; and means to releasably secure a boat within said boat slip.

2. A boat according to claim 1 wherein said dock guards are rotatable about their vertical axii.

3. A boat dock according to claim 1 wherein each of said intermediate guards comprises:

a vertical cylindrical member; and a thick walled tube formed of elastomeric material received on said cylindrical member.

4. A boat dock according to claim 1 wherein said intermediate guards are rotatable about their vertical axii.

5. A boat dock according to claim 1 wherein said means to releasably secure a boat within said boat slip includes:

a winch secured to said dock front between said pair of padded stop members and having a retractable flexible member extending therefrom, the flexible member having means at the outer end to attach to the bow of a boat.

* * * * *